United States Patent [19]

Knop

[11] Patent Number: 4,836,134

[45] Date of Patent: Jun. 6, 1989

[54] DEVICE FOR COATING A WEB OF MATERIAL

[75] Inventor: Reinhard Knop, Bochum, Fed. Rep. of Germany

[73] Assignee: Jagenberg Altiengesellschaft, Dusseldorf, Fed. Rep. of Germany

[21] Appl. No.: 171,582

[22] Filed: Mar. 22, 1988

[30] Foreign Application Priority Data

Mar. 24, 1987 [DE] Fed. Rep. of Germany ..... 3709295

[51] Int. Cl.[4] ..... B05C 5/02

[52] U.S. Cl. ..... 118/413; 118/410

[58] Field of Search ..... 118/410, 413; 427/356, 427/358

[56] References Cited

U.S. PATENT DOCUMENTS

| | | | |
|---|---|---|---|
| 3,301,214 | 1/1967 | Coghill | 118/413 X |
| 4,310,573 | 1/1982 | Damrau | 427/358 X |
| 4,558,658 | 12/1985 | Sommer et al. | 118/413 X |

FOREIGN PATENT DOCUMENTS

| | | |
|---|---|---|
| 3338323 | 5/1984 | Fed. Rep. of Germany . |
| 2825907 | 7/1984 | Fed. Rep. of Germany . |
| 8414904 | 3/1986 | Fed. Rep. of Germany . |
| 3336553 | 7/1986 | Fed. Rep. of Germany . |

*Primary Examiner*—Shrive Beck
*Assistant Examiner*—Alain Bashore
*Attorney, Agent, or Firm*—Sprung Horn Kramer & Woods

[57] ABSTRACT

A device for coating a web of material that travels around a backing roller, with a coating chamber that opens toward the backing roller, and with a liquid-coating intake that has an overflow gap at the paper-intake end and is closed off by a metering unit at the paper-exit end. The coating device allows establishment of a wider range of coating densities (e.g. 4–20 g/m$^2$) without great expenditure and without coating defects in the coating. The metering unit accordingly pivots independently of the coating chamber (3) around an axis that parallels that of the backing roller and is sealed off by a sealing structure (12) from the structure (6) that demarcates the coating chamber.

5 Claims, 2 Drawing Sheets

DEVICE FOR COATING A WEB OF MATERIAL

BACKGROUND OF THE INVENTION

The invention relates to a device for coating a web of material that travels around a backing roller.

Jet-coating devices are preferable when low coating densities (<7 g/m$^2$) are to be attained at high paper speeds (>700 m/min). Essential components of known jet coaters are

- a coating chamber that opens toward the backing roller and that is supplied with liquid coating from a preliminary-distribution chamber through a gap that extends across the operating width and
- a metering system in the form of a doctor that closes off the coating chamber at the paper-exit end.

The coating chamber is demarcated at the intake end by an overflow plate that terminates near the backing roller, leaving an overflow gap. The liquid flowing off through the overflow gap prevents air from entering the coating chamber along with the web. The chamber is sealed off at the sides by backup plates for example at the ends of the backing roller.

The structures, including the blade and its support (the blade beam), that demarcate the coating chamber constitute in the known coaters one structural unit that can be pivoted around an axis paralleling that of the backing roller. This integrated unit can be pivoted to vary the coating angle of the blade and accordingly the density of the coating.

A generic coater of this type is described in German GM No. 8 414 904. The coating density can additionally be varied in this coater by varying the distance of the doctor beam from the backing roller.

Another generic device is disclosed in German Pat. No. 3 336 553.

A serious drawback to the known jet coaters is that the coating density can be varied only within narrow limits because it is possible to affect it only to a limited extent by varying the coating angle of the blade. Since, that is, varying the angle has a negative effect on the flow conditions in the coating chamber, coating defects will occur as the result of undesirable turbulence, coating separation, and the invasion of air.

These negative consequences can, to the extent that they derive from changes in the overflow gap, be eliminated only by the complicated process of adjusting the dimension of the gap (at the overflow plate for example). Also necessary is, depending on the particular embodiment, a complicated readjustment of the lateral backup plates and of the structures that demarcate the edge of the coating.

Paper coaters in which the coating chamber is completely separated from the metering system are known. In this embodiment it is necessary to ensure an overflow of liquid coating from the coating chamber at both the paper-intake and paper-exit ends. Since this, however, leads to too high excess-coating rates, the paper speed is limited by the requisite head.

SUMMARY OF THE INVENTION

The object of the invention is to provide a generic coating device that will allow establishment of a wider range of coating densities (e.g. 4–20 g/m$^2$) without great expenditure and without coating defects in the coating.

This object is attained by the improvement wherein the metering system pivots independently of the coating chamber around an axis that parallels that of the backing roller and is sealed off by a sealing structure from the structure that demarcates the coating chamber.

An additional advantage is that the invention makes it possible for the first time to provide jet coaters with a system of blades wherein the tension can be varied extensively independently of the blade geometry in the vicinity of the metering point. A system of blades of this type is described in German Pat. No. 2 825 907.

Structures are also provided wherein the coating density can be controlled by pivoting the blade metering system.

A resilient sealing lip is also provided to allow the coating chamber to be sealed during movements relative to the metering system.

BRIEF DESCRIPTION OF THE DRAWINGS

Two embodiments of the invention with different metering systems will now be described in detail with reference to the drawings, wherein.

DETAILED DESCRIPTION OF THE INVENTION

Figure 1:
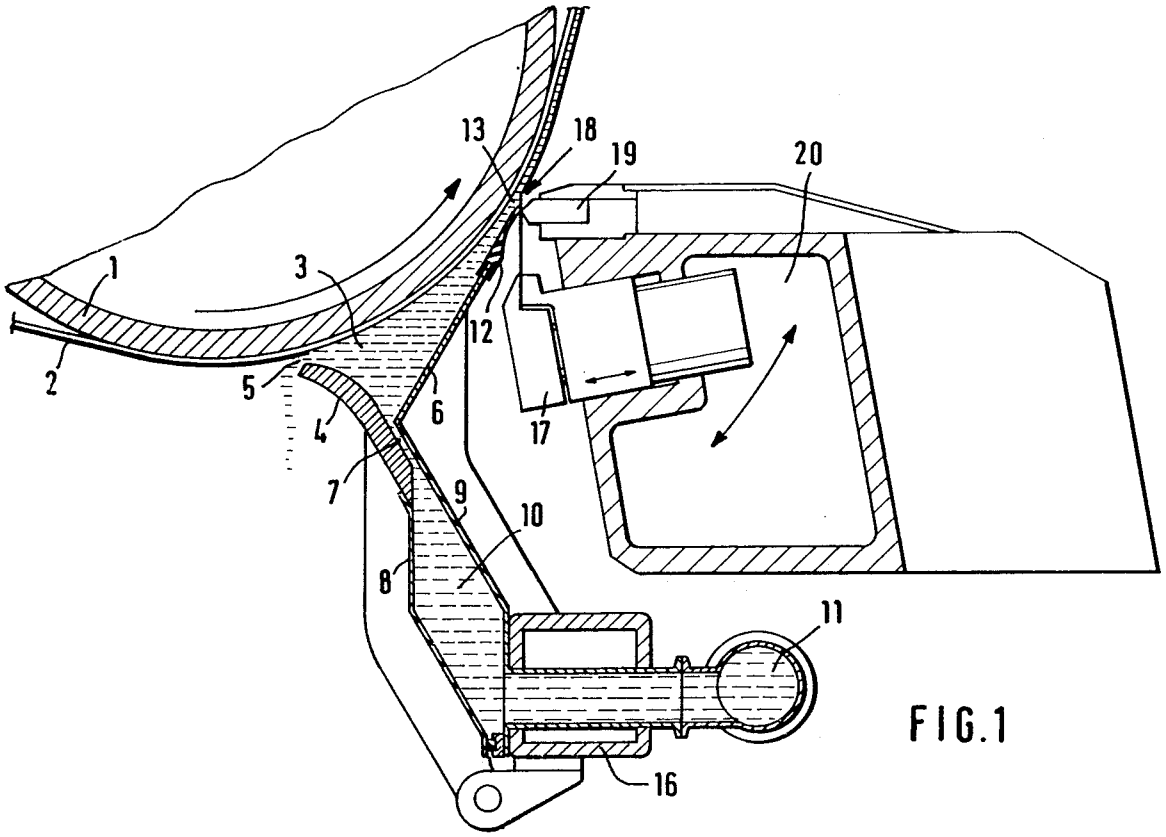
FIG. 1 is a section through a coater in accordance with the invention that employs a metering system in the form of a blade and FIG. 2 is a section through a coater with a metering system in the form of a resiliently supported metering bar.

Both embodiments of the device in accordance with the invention are employed to coat a web 2 of paper that travels around a backing roller 1. The coater, which has a constant cross-section perpendicular to the axis of the backing roller and along the operating width, has a coating chamber 3 that is demarcated at the paper-intake end by an overflow plate 4 that terminates a specific distance upstream of backing roller 1, leaving an overflow gap 5.

Downstream in the direction traveled by the paper is a chamber floor 6, with an intake slot 7 for the liquid coating left open between it and overflow plate 4. The mount 8 for overflow plate 4 constitutes, in conjunction with a plate 9, to which chamber floor 6 is secured at an angle, an expanding preliminary-distribution chamber 10 connected to a coating-supply system 11.

At the paper-exit end, chamber floor 6 has an extension in the form of a resilient lip 12 that rests against and seals off a metering system demarcating the exit end of coating chamber 3. The sealing lip 12 in the embodiment illustrated in FIG. 1 rests against a blade 13, and that in the embodiment illustrated in FIG. 2 against a mount 14 for a metering bar 15.

The components 4, 6, 8, and 9 that demarcate preliminary-distribution chamber 10 and coating chamber 3 are mounted in conjunction with sealing lip 12 along with liquid-coating supply system 11 on a pivoting supporting structure 16 that extends over the width of the machine, and can be pivoted away from backing roller 1 and toward where the web enters. For cleaning purposes, overflow plate 4 can also be folded up along with its mount 8 against the direction that the paper travels.

The embodiment illustrated in FIG. 1 has a metering system with a blade 13, the foot of which is securely tensioned in a moveable clamping beam 17 and which is supported below the metering point 18 by a comb batten 19. Clamping beam 17 and comb batten 19 are mounted in a doctor beam 20 that pivots around metering point 18.

Figure 2:
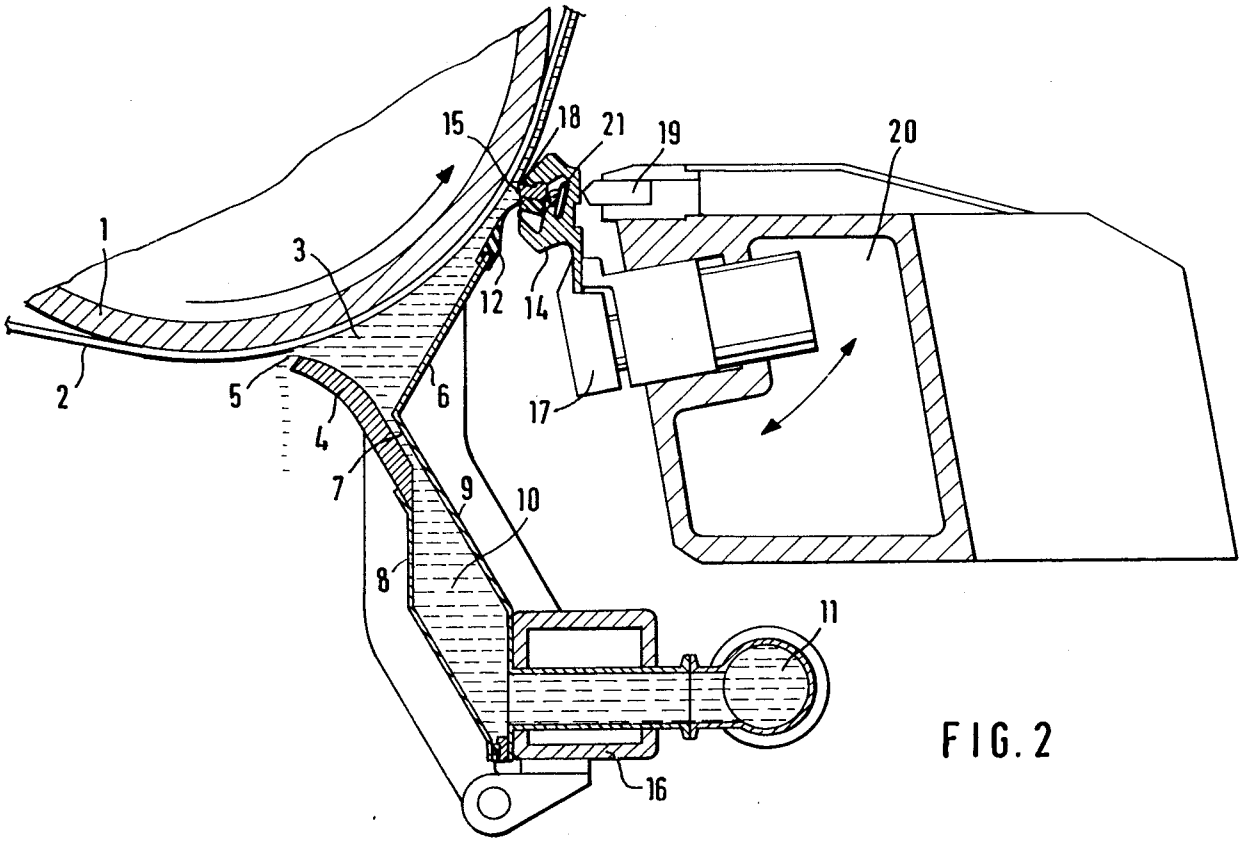

The metering system in the embodiment illustrated in FIG. 2 also has a pivoting doctor beam 20 with a clamping beam 17. The metering device is a metering bar 15 with a mount 14 that is securely tensioned in a clamping beam 17. Mount 14 is wider at the head and constitutes a bed for metering bar 15, which is resiliently supported by a hose 21 charged with compressed air. This metering system is described in detail in German OS No. 3 338 323.

How the web 2 of paper that travels around backing roller 1 is coated will now be described. Liquid coating is applied to web 2 in coating chamber 3, with the desired density being established by means of blade 13 or metering bar 15. For this purpose excess coating is continuously supplied through intake slot 7, maintaining coating chamber 3 constantly full. The excess coating escapes through overflow gap 5 in a direction opposite the direction that the web travels in and accordingly prevents entry of the layer of air entrained along with moving web 2. The metering unit (blade 13 in FIG. 1 or metering bar 15 in FIG. 2) positioned where the web exits controls the flow of coating in accordance with the desired density by retaining the excess portion of the liquid coating that flows along with the moving web in coating chamber 3.

The metering system in each embodiment can be pivoted around metering point 18 independently of coating chamber 3, making it possible to control the coating density by varying the coating angle (the angle between blade 13 or metering bar 15 and web 2) over a wide range. Resilient sealing lip 12 seals coating chamber 3 off from the particular metering system in the different positions. Since coating chamber 3 is, up to and including blade 13 or metering bar 15, independent of the motion of comb batten 19, the geometry of coating chamber 3, including overflow gap 5, remains essentially constant.

The geometrical changes that result from the motion of the metering structures are so slight in the vicinity of metering point 18 that they are compensated by changes in the shape of sealing lip 12. Clamping beam 17 can be moved linearly to adjust the tension on blade 13 or the pressure of the air in hose 21 varied to adjust the tension on metering bar 15 without negatively changing the geometry in the vicinity of metering point 18. Doctor beam 20 can also be pivoted away from backing roller 1 to introduce the web and for cleaning.

It is understood that the specification and examples are illustrative but not limitative of the present invention and that other embodiments within the spirit and scope of the invention will suggest themselves to those skilled in the art.

What is claimed is:

1. In a device for coating a web of paper that travels around a backing roller, the device having a coating chamber that opens toward the backing roller, and a liquid-coating intake, the chamber having an overflow gap at the paperintake end and being closed off by a metering unit at the paper-exit end, the improvement wherein the metering unit pivots independently of the coating chamber (3) around an axis that parallels that of the backing roller and is sealed off by a sealing structure (12) for the coating chamber.

2. A device according to claim 1, wherein the metering unit includes a blade (13) secured in a pivoting doctor beam (20).

3. A device according to claim 2, wherein the coating chamber has a floor, and the sealing structure is in the form of a resilient sealing lip (12) that is secured to the floor (6) of the coating chamber and rests against the blade (13).

4. A device according to claim 1, wherein the metering unit includes a metering bar (15) resiliently supported in a pivoting mount (20).

5. A device according to claim 4, wherein the coating chamber has a floor, and the sealing structure is in the form of a resilient sealing lip (12) that seals the bed for the metering bar (15) off from the floor (6) of the chamber.

* * * * *